United States Patent [19]

Stötzer et al.

[11] Patent Number: 5,035,071

[45] Date of Patent: Jul. 30, 1991

[54] TRENCH WALL CUTTER

[75] Inventors: Erwin E. Stötzer, Aichach; Peter Teschemacher, Schrobenhausen, both of Fed. Rep. of Germany

[73] Assignee: Bauer Spezialtiefbau GmbH, Schrobenhausen, Fed. Rep. of Germany

[21] Appl. No.: 418,023

[22] Filed: Oct. 10, 1989

[30] Foreign Application Priority Data

Oct. 14, 1988 [DE] Fed. Rep. of Germany ..... 3835123

[51] Int. Cl.[5] ..... E02F 5/08

[52] U.S. Cl. ..... 37/94; 37/189; 299/86; 299/94; 405/267

[58] Field of Search ..... 405/266, 267; 37/91, 37/90, 87, 88, 56, 65, 94, 189; 299/38–41, 86, 94

[56] References Cited

U.S. PATENT DOCUMENTS

| | | | |
|---|---|---|---|
| 2,998,964 | 9/1961 | Morlan | 299/86 X |
| 3,050,292 | 8/1962 | Newton et al. | 299/86 |
| 3,362,753 | 1/1968 | Sibley | 299/86 X |
| 3,888,544 | 6/1975 | Bennett | 299/41 X |
| 4,371,210 | 2/1983 | Leibee | 299/86 X |
| 4,755,001 | 7/1988 | Gilbert | 37/87 X |

FOREIGN PATENT DOCUMENTS

| | | | |
|---|---|---|---|
| 0263762 | 4/1988 | European Pat. Off. | 37/91 |
| 0291027 | 11/1988 | European Pat. Off. | 37/91 |
| 1523159 | 3/1968 | France | 37/91 |
| 0211424 | 9/1986 | Japan | 37/91 |

*Primary Examiner*—Dennis L. Taylor

*Attorney, Agent, or Firm*—Fleit, Jacobson, Cohn, Price, Holman & Stern

[57] ABSTRACT

In particular for the production of trenches in medium hard to hard rock, the cutting wheels of the trench wall cutter are equipped with rolling tools, whose cutting faces are parallel to the bore axis. The cleaning of the bottom of the bore and the transportation of the material to the suction point preferably takes place with the aid of brushes. Further brushes arranged on the cutting frame are used for cleaning the tools.

10 Claims, 5 Drawing Sheets

TRENCH WALL CUTTER

BACKGROUND OF THE INVENTION

The invention relates to a trench wall cutter with at least two oppositely rotating cutting wheels mounted on a cutting frame and circumferentially provided with soil-breaking tools.

Such cutters are used for making trench walls in the case of foundation trenches, dikes and foundations. In the known trench wall cutters, the cutting wheels are equipped with tearing teeth, which cut or break the ground and transport inwards crushed soil fragments where they are sucked away with a supporting liquid. The cutter is lowered vertically under continuous rotation of the cutting wheels and depths of 100 m and more can be reached. The advance is brought about by the weight of the cutting wheels and the cutting frame, which is hung by means of a cable line to a crawler crane.

Although the presently used trench wall cutters, in which the soil or ground is cut with tearing teeth, can be used in the case of almost all soil types in such a way as to achieve good boring or drilling results, it has been found that considerable wear to the tearing teeth is unavoidable in the case of very hard rocks.

SUMMARY OF THE INVENTION

The problem of the invention is to provide a trench wall cutter of the aforementioned type, in which also in the case of high resistance to rocks, a good boring advance and good free-cutting of the cutting wheels is achieved.

This problem is solved in that the cutting wheels are equipped with rolling tools, which are oriented axially parallel to the cutting wheel axes with a one-sided mounting in order to obtain the free-cut.

The effect of the rolling tools is that as a result of the rolling engagement with the bottom of the bore hole under an applied load, it is possible to locally exceed the rock strength and to split off the rock into small fragments. The tools are consequently only temporarily in engagement with the ground, each tool being exposed to substantially the same loading during rotation. However, the force for detaching the soil is determined not only by the applied load, but by the torque acting on the cutting wheels, as a function of the position of the particular tool in the worked trench semicircle.

As the boring advance, which is determined by the contact pressure per tool and the number of engagements per surface unit, is substantially independent of the diameter of the trench to be produced or the projection surface of the cutting wheel on the trench bottom, the applied load does not have to be increased in the same way with increasing trench diameter. Therefore the dead load to be moved in the case of a location change can be kept relatively small.

According to a preferred further development of the invention, the tools are constructed as cutting rolls, which are mounted on one side with an axial projection with respect to the cutting wheel. Thus, they can be mounted in simple manner on the particular cutting wheel and can, if necessary, be replaced when worn. It is particularly advantageous to axially stagger the tools on the cutting wheels.

Good boring results can be obtained in that the cutting rolls are constructed as at least a single-ring roll with a ring tooth. In addition, the ring tooth can be constructed as a button or stud ring tooth.

In a particularly appropriate manner the cutting rolls have a frustum shape or in axial section a trapezoidal shape. The one-sided mounting of these cutting rolls is preferably provided in the extention of the radial outer face of the cutting wheel. Considered over the circumference, on one side of the cutting wheel roughly four cutting rolls are fitted and on the opposite side thereof an equal number of cutting rolls, but they are circumferentially staggered. The circumferential surface of the frustrum shape of the cutting rolls and the rotation axis of the cutting rolls or their inclination with respect to the axis of the cutting wheels are matched in such a way that with respect to the bottom of the bore hole a roughly parallel cutting face to the axis of the cutting wheels is obtained. The cutting rolls are mounted by means of an approximately triangular bearing block, which can be roughly aligned with the radial outer face of the cutting wheels. However, the cutting rolls are mounted in such a way that their wider base, i.e. the corner region on the bottom of the bore hole projects axially at least slightly over the outer face of the associated cutting wheel. This construction of the roughly axially parallel cutting faces and the axial projection advantageously leads on the one hand to a free-cutting of the cutting wheels and on the other hand in a vertical sectional view a substantially rectangular bore, also in the vicinity of the bottom of the bore hole.

The design and arrangement of the cutting rolls in the aforementioned form during the drilling or boring process leads to a pressing and grinding effect with respect to the bottom region in the vicinity of the bottom of the bore hole, said effect being further increased by the one-sided mounting with a better force transfer to the cutting rolls.

The cutting rolls have on the circumferential surface of the frustrum shape in the corner regions preferably rounded and almost hemispherical studs made from hard metal, e.g. a hardened steel. Between these studs are provided in the circumferential surface further breaking tools in the form of tips and, if possible, the breaking tools are reciprocally displaced. With a view to an easy replacement, both the studs and the tips can be inserted into the circumferential surface of the cutting roll.

In the case of a pairwise, coaxial arrangement of the cutting wheels, in which between the two cutting wheels is provided a bearing plate or bracket receiving the spindles and the gear, it is very appropriate to arrange on those edges of the cutting wheels which face the bearing bracket, in the axial direction pivotable bearings for the cutting rolls, so that upstream of the bearing bracket the cutting rolls can be pivoted in the feed direction. This prevents a ridge building up between the cutting wheels on which the bearing bracket is mounted, so that sinking is prevented.

In order to assist the transporting away of the loosened soil, it is advantageous to position brushes on the cutting wheels. These brushes are used for cleaning the bottom of the bore hole and the bored material can be transported away for suction.

According to a further preferred development of the invention further brushes are arranged over the width of the cutting wheels on the cutting frame and engage with the tools. This measure has the advantage that the tools are cleaned during each rotation of the cutting wheels and it is possible to prevent any sticking together, e.g. in the case of clayish material.

DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENT

Figure 1:
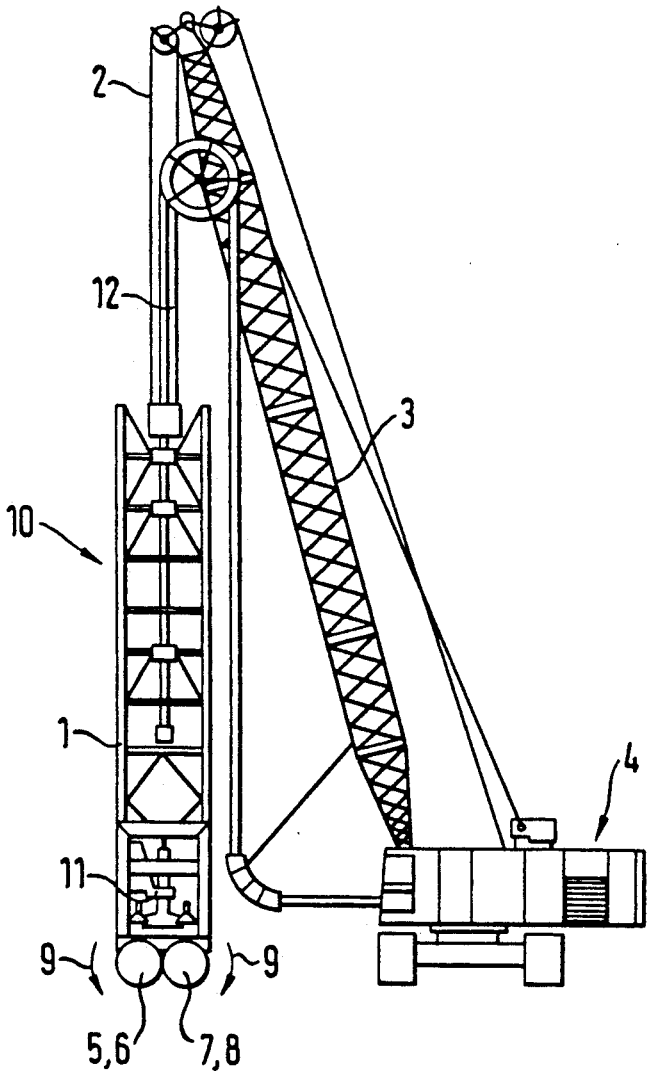
FIG. 1 diagrammatically a view of a trench wall cutter.

FIG. 1 illustrates a trench wall cutter 10. It comprises a cutting frame 1, which is suspended by means of a cable line 2 on a cantilever arm 3 of a carrier means 4 equipped with a crawler chassis. Cutting frame 1 carries oppositely rotating cutting wheels 5, 6 and 7, 8 arranged in pairwise manner. In FIG. 1 the cutting wheels are oriented in the plane of the drawing, i.e. in each case one cutting wheel of each pair is concealed by another cutting wheel. The opposite rotation is indicated by arrow 9.

A trench is made in that the cutting frame 1 is vertically lowered, accompanied by the continuous rotation of cutting wheels 5 to 8, the advance being produced by the weight of the cutting wheels 5 to 8 and the cutting frame 1. The loosened soil is transported inwards by the cutting wheels 5 to 8 to a suction means 11, where it is sucked off with a supporting liquid by means of a hose line 12.

Figure 2:
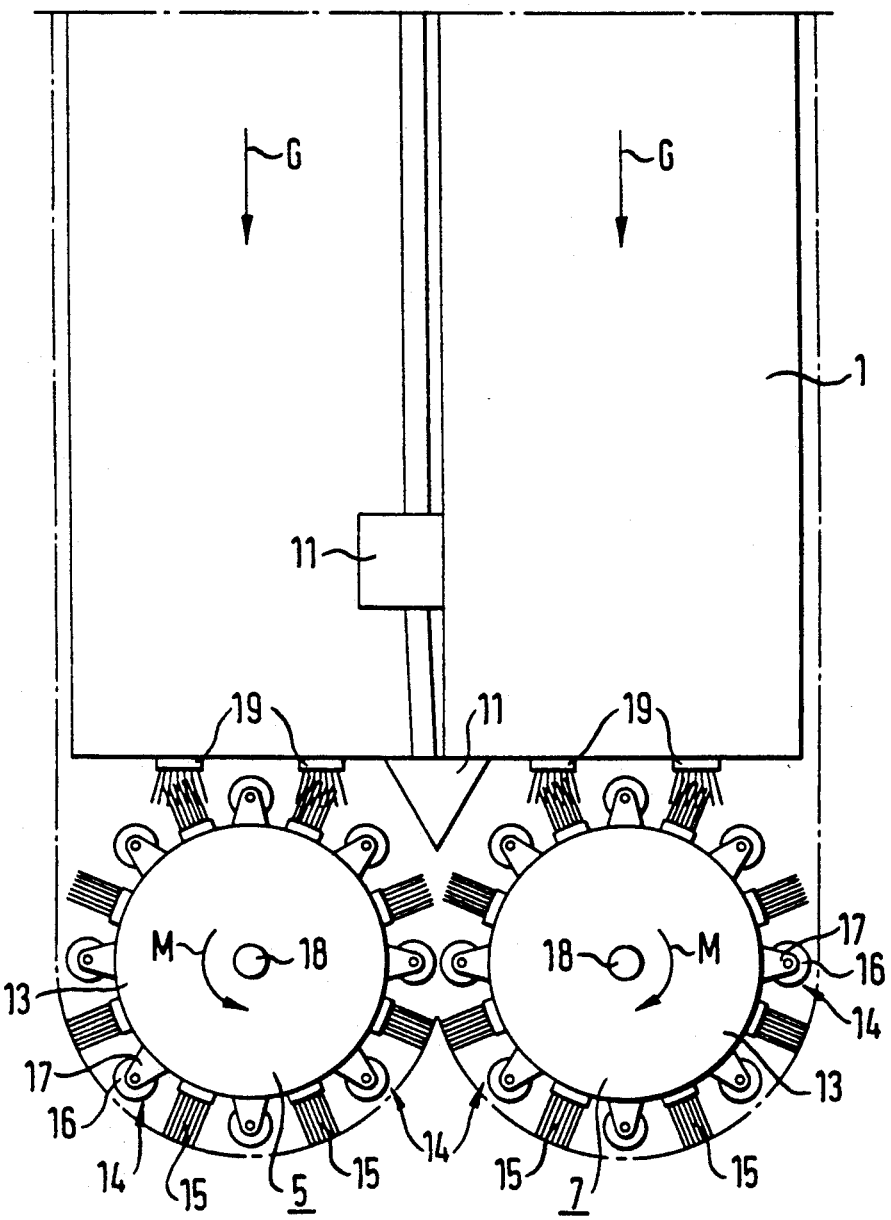
FIG. 2 diagrammatically an axial view on the cutting frame and cutting wheels of a trench wall cutter according to FIG. 1.

FIG. 2 makes it clear that the cutting wheels are equipped over the circumference of their hubs 13 with rolling tools 14 and brushes 15. The tools 14 in each case comprise cutting rolls 16, which are mounted in rotary manner in fork-like mounting supports 17. The rotation axis or spindle of the cutting roll 16 is substantially parallel to the rotation axes or spindles 18 of cutting wheels 5 to 8.

During sinking, as a result of the rotation of cutting wheels 5 to 8, tools 14 temporarily engage with the bottom of the bore hole in the vicinity of the semicircle located in the advance direction. As a result of the applied load G, as well as the torque M acting on the cutting wheels 5 to 8, the soil is loosened. The crushed material is conveyed inwards by brushes 15 to the suction means 11. In place of brushes 15, it would also be possible to use other means, e.g. ribs or the like for the lateral transporting away of the bored material.

Further brushes 19 are arranged in fixed manner on the cutting frame 1 in such a way that during the rotation of wheels 5 to 8, the tools 14 necessarily come into engagement therewith, so that any soil adhering thereto is removed.

Figure 3:
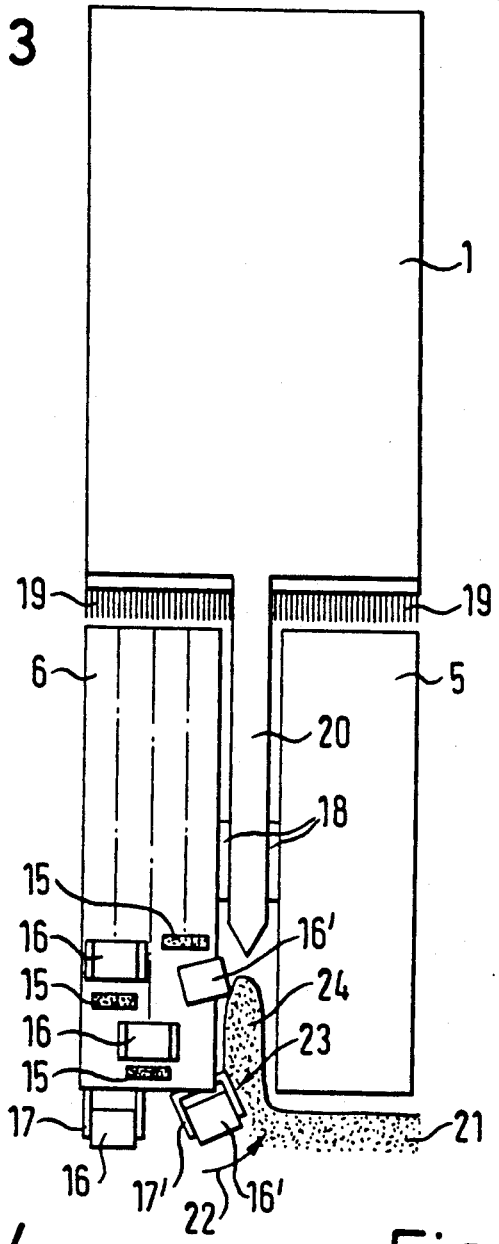
FIG. 3 diagrammatically a view at right angles to the axial direction of the cutting frame and cutting wheels according to FIG. 2.

FIG. 3 clearly shows the pairwise arrangement of the cutting wheels with particular reference to the pair comprising wheels 5,6. The following description applies accordingly to the two other cutting wheels 7,8. The cutting wheels 5,6 are mounted coaxially on a bearing bracket 20, via which the drive is also introduced into wheels 5,6.

In the represented embodiment, the cutting rolls 16 are staggered in several rows running in the circumferential direction of the cutting wheels 5,6. Between them are located the brushes 15, which if possible are also staggered. On the edges of the cutting wheels 5,6 adjacent to the bearing bracket 20 are pivotably articulated the mounting supports 17' of the cutting rolls 16' in the direction of arrow 22, so that they can flap in laterally and in the advance direction upstream of the bearing bracket 20. In this pivoted down position indicated at 23, the particular cutting rolls 16' act on the rock 24 located between the two cutting wheels 5,6 and prevent the formation of a ridge. The pivot axis of the mounting supports 17' is directed substantially tangentially to the wheels 5,6.

Pivoting in can be initiated on the one hand automatically as a result of the resistance offered by the bottom 21 of the bore to the cutting rolls 16', or on the other hand by a forced control (not shown). The pivoting back takes place by means of a not shown control ledge constructed on the bearing bracket 20 and with which the cutting rolls 16' engage.

Figure 4:
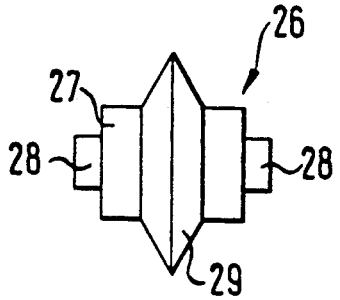
FIG. 4 and 5 in each case an example of a cutting roll.

FIG. 4 shows a cutting roll constructed as a single-ring roll 26. It comprises a substantially cylindrical body 27 with journals 28 and a ring tooth 29.

Figure 5:
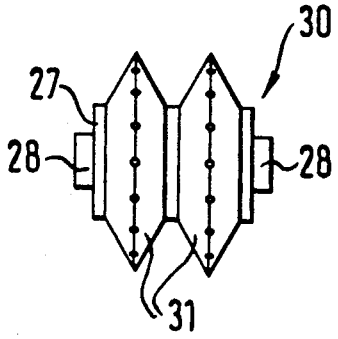

FIG. 5 shows a cutting roll 16 constructed as a two-ring roll 30, whose body 27 carries two stud or button-like ring teeth 31.

If it proves advantageous and necessary for the rock to be worked, it is also possible to fit more than two ring teeth, which may be constructed either smooth or provided with studs, teeth and the like. The individual ring teeth can also have different external diameters and cross-sections.

Figure 6:
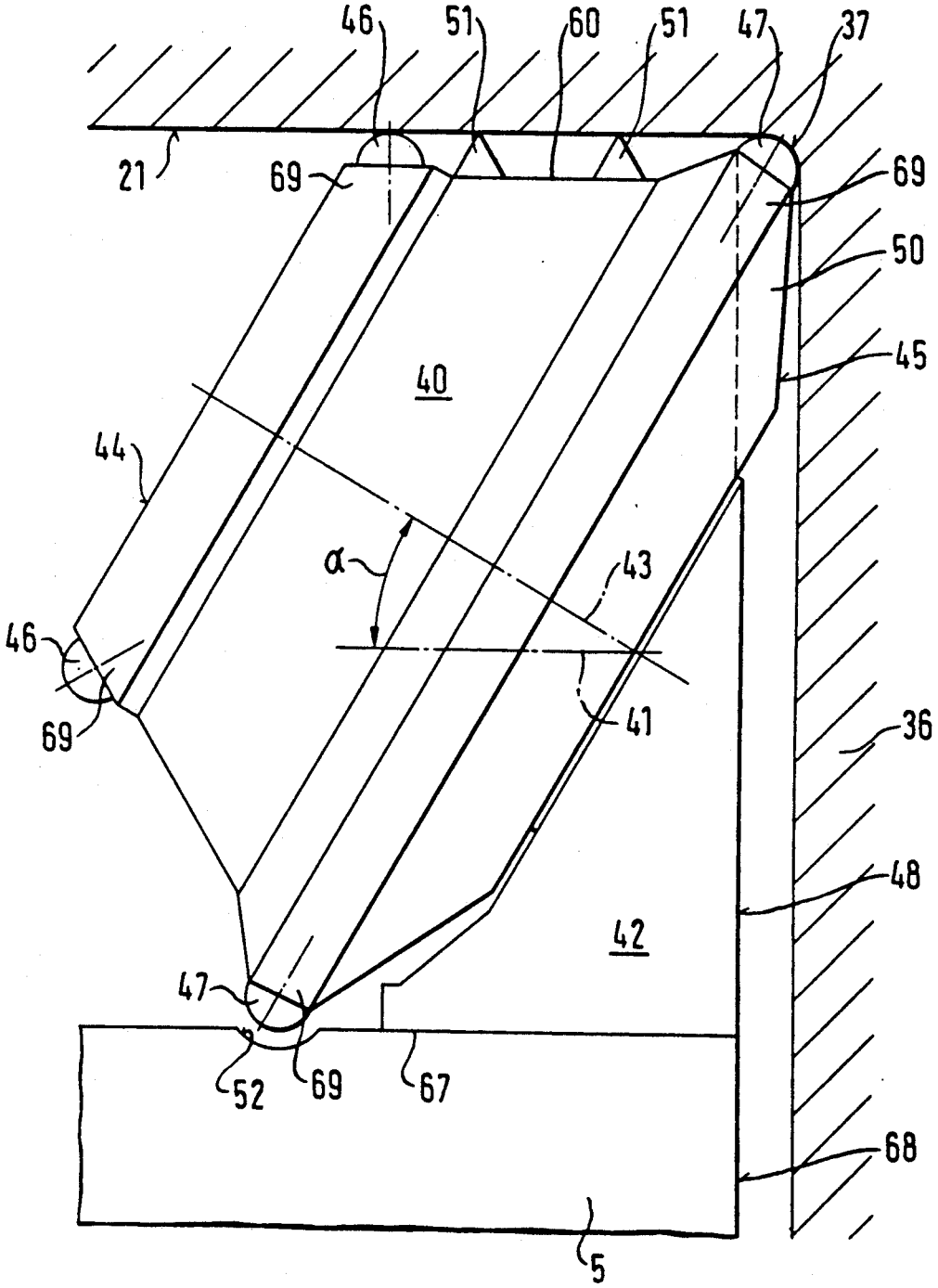
FIG. 6 a frustum-shaped cutting roll with one-sided mounting on the circumferential wall of a cutting wheel shown in fragmentary form, the bottom the bore hole being shown in the upper part of the drawing.

FIG. 6 is a side view of a cutting roll 40, which is substantially frustum-shaped notably the roll has a frusto-conical surface 60. This cutting roll 40 is so positioned with respect to the axis of the cutting wheel 5 by inclining its rotation axis or spindle 43 by an angle $\alpha$, that the cutting line defined by surface 60 at the top in the drawing is roughly parallel to the rotation axis of the cutting wheel 5 with respect to the bottom of the bore 21. Apart from this parallelism, it is particularly important that the right-hand upper, projecting area 50 has a small, axial projection over the outer face 48 of a corresponding bearing block and the outer face 68 of the cutting wheel. As a result of this projecting area 50, it is ensured that there is "free-cutting" of the cutting wheels during sinking.

The cutting roll 40, which is frustum-shaped or approximately trapezoidal in section, is mounted in rotary manner on a bearing block 42. The inclination of the rotation axis 43 and the arrangement of the circumferential surface of the frustum jacket are such that the cutting face 60 is roughly parallel to the axis of the cutting wheel 5. In this circumferential surface of the frustum jacket are provided first and second rim portions 69 each with circumferentially disposed breaking tools in the form of hemispherical studs 46 or 47 made from hard metal. Hard metal tips or spikes 51 are provided between them on the frusto-conical surface 60. These breaking tools 46 and 51 are designed to permit easy replacement.

These breaking tools 46,51 are normally arranged in circular, but reciprocally displaced manner over the circumference.

It is particularly noteworthy that stud 47, which comes into engagement with the soil 36 in corner area 37 permits an almost rectangular bore and as a result of the projecting area 50 prevents any rubbing of the cutting wheels with respect to the soil 36.

As a result of the frustum-shaped design of the cutting roll, it is appropriate to provide a groove-like recess 52 in the circumferential surface 67 of the cutting wheel 5 and this is roughly complimentary to the outer circumference of studs 47 in corner area 69.

Cutting roll 40 is mounted in the vicinity of its side 41 by means of an approximately triangular bearing block 42, whilst the opposite side 44 is so-to-speak kept free.

As FIG. 6 only shows a cutting wheel 5 is fragmentary manner, it is pointed out that a homologous addition to the left is necessary, in order to be able to conceive the complete function of a cutting wheel. The then facing cutting rolls 40 are then staggered over the circumference and on both outer faces of the cutting wheel the projecting area 50 can be present.

Figure 7:
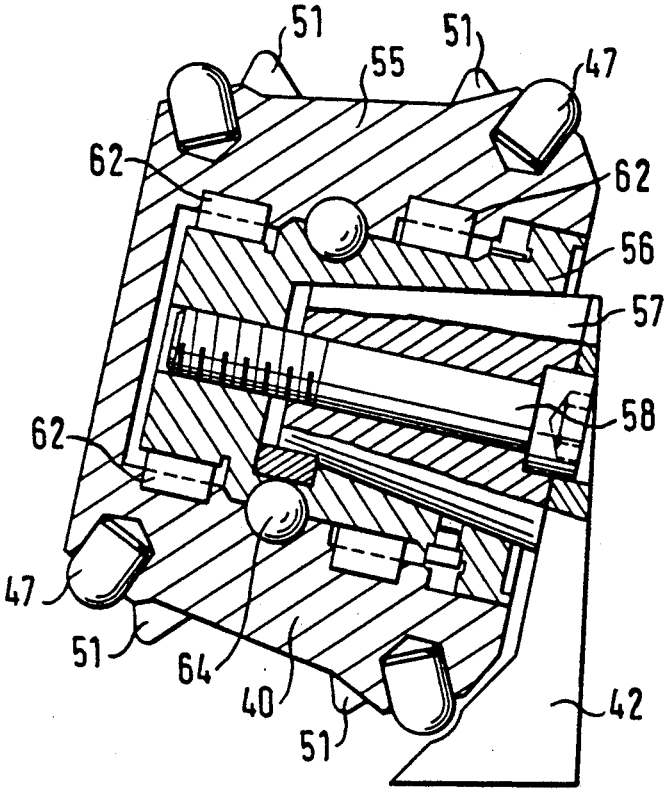
FIG. 7 an axial section through a comparable cutting roll to that of FIG. 6.

FIG. 7 is a sectional representation of an embodiment of a cutting roll 40 according to FIG. 6 further illustrating the mounting thereof. The cutting roll 40 comprises an outer roll jacket 55, which is rotatable by means of roller bearings 62 and a central ball bearing 64 on an inner jacket 56. A frustum-shaped cone or taper sleeve 57 engages with press fit in said inner jacket 56. The taper sleeve 57 is fixed by means of a screw 58 in FIG. 7 to the bearing block 42. The thread of the front region of the screw 58 engages in the inner jacket 56. The remaining reference numerals correspond to the embodiment of FIG. 6.

What is claimed is:

1. A trench wall cutter comprising a cutting frame, a cutting wheel having a substantially cylindrical outer surface and a cylinder axis, means mounting the wheel for rotation on the frame about said cylinder axis, a soil-breaking took having a central axis and a substantially frusto-conical outer surface symmetrically disposed with respect to the central axis, and mounting means mounting the tool on said cylindrical surface of the wheel for rotation about said central axis, the tool being mounted on the wheel at an angle wherein said frusto-conical surface defines an outer cutting line which is substantially parallel to said cylinder axis.

2. A cutter as defined in claim 1 wherein the tool has a base portion and a top portion, said portions being connected by said frusto-conical surface, wherein the base portion is mounted on said mounting means adjacent one end of said cylindrical surface, and said frusto-conical surface extends towards an opposite end of the cylindrical surface.

3. A cutter as defined in claim 2 wherein the base portion of the soil-breaking tool has a first outer rim portion which extends beyond said one end of the cutting wheel and extends outwardly of said frusto-conical surface.

4. A cutter as defined in claim 3 wherein said first outer rim portion of the soil-breaking tool is provided with circumferentially disposed rounded soil-breaking studs.

5. A cutter as defined in claim 4 wherein the top portion of the soil-breaking tool has a second outer rim portion also provided with circumferentially disposed rounded soil-breaking studs.

6. A cutter as defined in claim 5 wherein the frusto-conical surface of the soil-breaking tool extends between the first and second rim portions and is provided with circumferentially disposed soil-breaking spikes.

7. A cutter as defined in claim 4, wherein said studs extend towards engagement with said outer surface of the wheel and said outer surface has a circumferential groove to accommodate the studs.

8. A cutter as defined in claim 1 wherein the soil-breaking tool has an outer roll casing defining the frusto-conical surface, and inner casing on which the outer casing is rotatably mounted and a tapered sleeve securing the inner casing to the mounting means.

9. A cutter as defined in claim 1 wherein the soil-breaking tool is replicated around the circumference of the wheel.

10. A cutter as defined in claim 1 wherein the wheel is replicated on the frame with the respective wheels being aligned on parallel cylinder axes.

* * * * *